United States Patent [19]

Morishita et al.

[11] 4,257,235

[45] Mar. 24, 1981

[54] GAS TURBINE ENGINE WITH FUEL-AIR PREMIX CHAMBER

[75] Inventors: Teru Morishita; Manabu Kazaoka, both of Susono, Japan

[73] Assignee: Toyota Jidosha Kogyo Kabushiki Kaisha, Toyota, Japan

[21] Appl. No.: 964,051

[22] Filed: Nov. 27, 1978

Related U.S. Application Data

[63] Continuation of Ser. No. 798,987, May 20, 1977.

[30] Foreign Application Priority Data

Mar. 14, 1977 [JP] Japan ..... 52/26967

[51] Int. Cl.[3] ..... F02C 7/22

[52] U.S. Cl. ..... 60/736; 60/737

[58] Field of Search ..... 60/39.65, 39.71, 39.74 R, 60/39.36, 736, 737; 431/242–246, 198, 199, 201; 239/419–419.5, 433, 427–427.5

[56] References Cited

U.S. PATENT DOCUMENTS

| | | | |
|---|---|---|---|
| 2,679,137 | 5/1954 | Probert | 60/39.65 |
| 2,720,081 | 10/1955 | Tutherly | 60/39.71 |
| 2,960,823 | 11/1960 | Fox | 60/39.71 |
| 3,603,082 | 9/1971 | Sneeden et al. | 60/39.71 |
| 3,847,534 | 11/1974 | Nomaguchi et al. | 431/243 |
| 3,934,641 | 1/1976 | Chielens | 239/433 |
| 3,982,392 | 9/1976 | Crow | 60/39.65 |

FOREIGN PATENT DOCUMENTS

| | | | |
|---|---|---|---|
| 1024755 | 2/1958 | Fed. Rep. of Germany | 60/39.74 |
| 74185 | 11/1960 | France | 60/39.71 |
| 712843 | 8/1954 | United Kingdom | 60/39.71 |

*Primary Examiner*—Robert E. Garrett

*Attorney, Agent, or Firm*—Stevens, Davis, Miller & Mosher

[57] ABSTRACT

Disclosed is a gas turbine engine provided with an annular pre-mixing chamber and an annular combustion chamber adapted for burning a combustible mixture from the pre-mixing chamber. A plurality of circumferentially arranged injection nozzle sets are located between the pre-mixing chamber and the combustion chamber so that the combustible mixture from the pre-mixing chamber is ejected into the combustion chamber, to cause the mixture to be burnt therein. Each injection nozzle set is comprised of at least two nozzles which are inclined with respect to each other in such a manner that a violent contact of the flows of combustible mixture passed through the nozzles occurs at a location in the combustion chamber causing a turbulence of flow to be generated therein. Thus, rapid and stable combustion can be effected.

3 Claims, 6 Drawing Figures

GAS TURBINE ENGINE WITH FUEL-AIR PREMIX CHAMBER

This is a Continuation of application Ser. No. 798,987 filed May 20, 1977.

FIELD OF THE INVENTION

The present invention relates to a gas turbine engine provided with an annular pre-mixing chamber and an annular combustion chamber.

BACKGROUND OF THE INVENTION

In an automobile a small size gas turbine engine is used that is provided with an annular combustion chamber. When the fuel is directly supplied to the combustion chamber, rapid combustion cannot be carried out because of an imperfect mixing of the fuel with air. This causes a large amount of $NO_x$ component to be generated, which is exhausted into the atmosphere.

To remedy this drawback, a gas turbine engine has already been provided that has an annular pre-mixing chamber arranged upstream of the annular combustion chamber. The annular pre-mixing chamber serves to obtain a well mixed air-fuel mixture which is supplied to the annular combustion chamber.

SUMMARY OF THE INVENTION

An object of the present invention is to provide a gas turbine engine provided with an annular combustion chamber as well as an annular pre-mixing chamber, capable of effecting a very rapid combustion.

Another object of the present invention is to provide a gas turbine engine capable of effectively decreasing $NO_x$ component emission.

Still another object of the present invention is to provide a gas turbine engine which is very conveniently utilized for an automobile.

The above objects can be attained by a gas turbine engine according to the present invention which comprises: a housing assembly; a shaft rotatably supported by the housing assembly; a set of compression blades fixed to the shaft; said housing assembly forming an outer air passageway of annular shape adapted for receiving a flow of air at high speed from the compression blades and an inner air passageway of annular shape adapted for receiving the flow of air from the outer air passageway; a set of turbine blades fixed to the shaft in the housing assembly so that the turbine blades are spaced apart from the compression blades; tube means for forming a combustion chamber located inside the housing assembly, said combustion chamber on a downstream side thereof, facing the turbine blades so that a flow of combustion gas of very high speed is directed toward the turbine blades to rotate the shaft; ring means located in the inner air passageway for forming a mixing chamber of an annular shape on an upstream side of the annular combustion chamber, said ring means defining a plurality of circumferentially arranged air intake holes adapted for introducing air in the inner air passageway into the mixing chamber; and; means for introducing evaporative fuel into the mixing chamber for permitting the evaporative fuel to be mixed with the air in the mixing chamber to form a combustible mixture, said ring means defining a plurality of circumferentially spaced injection nozzle sets adapted for ejecting a combustible mixture in the mixing chamber into the combustion chamber, each of said nozzle sets being comprised of at least two injection nozzles having axes which are inclined with respect to each other in such a manner that the axes intersect each other at a position in the annular combustion chamber. Thus, a violent contact of flows of a combustible mixture ejected from each set of the injection nozzle occurs in said combustion chamber, causing a strong turbulence of flow to be generated in the combustion chamber.

DESCRIPTION OF PREFERRED EMBODIMENTS

Figure 1:
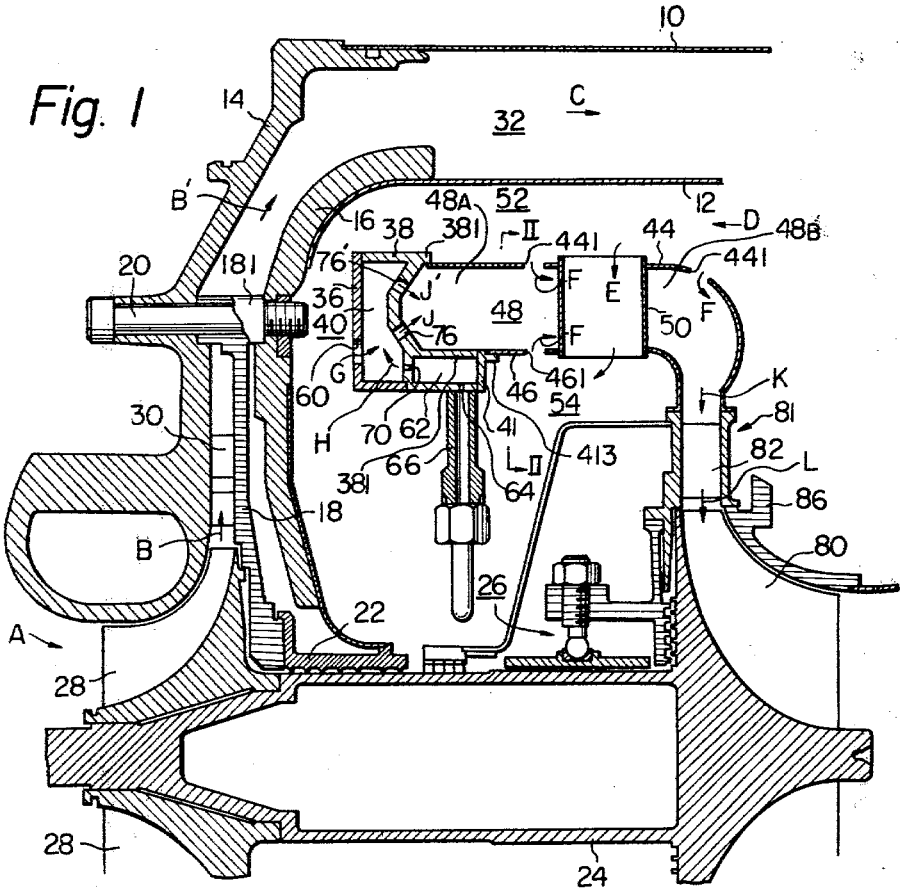
FIG. 1 is a longitudinal cross-sectional view showing a part of a gas turbine engine according to the present invention.

Referring to FIG. 1, numeral 10 designates an outer tubular housing in a gas turbine engine of the present invention. Inside the outer housing 10, an inner tubular housing 12 is coaxially arranged. An outer front housing 14 of plate shape is fixedly secured to the front end of the outer tubular housing 10 and an inner front housing 16 of plate shape is fixedly secured to the front end of the inner tubular housing 12. A disc member 18 is disposed between the outer front housing 14 and the inner front housing 16. The disc member 18 has, on the outer periphery thereof, a plurality of spaced apart boss portions 181 (only one of which is shown in FIG. 1), through which bolts 20 are inserted to rigidly connect the disc member 18 to the outer and inner front housings 14 and 16 respectively. The disc 18 has, at the center thereof, a sleeve member 22.

A main shaft 24 inserted to the sleeve member 22 is supported by a not shown bearing device on one end of the shaft 24. The other end of the main shaft 24 is supported by a well known gas bearing device 26. Therefore, high speed rotation of the shaft 24 with respect to the housings 10, 12, 14 and 16 can be effected.

A set of equiangularly spaced compression blades 28 are fixedly secured to the main shaft 24. A set of equiangularly spaced diffuser blades 30, each of which is integrally formed with the disc member 18, is arranged around the set of compression blades 28, so that an air flow of very high speed from the compression blades 28 is directed to the diffuser blades 30 as shown by an arrow B. This air flow is then, as shown by an arrow B′, directed to an outer annular air passageway 32 formed between the outer tubular housing 10 and the inner tubular housing 12.

A ring member 36 of L shaped cross-section, which is coaxial to the main shaft 24, is stationarily located in an inner air passageway 52 formed inside the inner tubular housing 12. This passageway 52 is connected to the outer air passageway 32 via a not shown heat exchanging mechanism adapted for introducing pre-heated air into the inner air passageway 52 as shown by an arrow D. Another ring member 38 is rigidly secured to the ring member 36 in a side by side relation so that a pre-mixing chamber 40 of annular shape is formed between the ring members 36 and 38. A ring shaped plate member 41 is rigidly secured to the other ring member 38 at a side opposite to the ring member 36, so that a fuel evaporation chamber 62 of annular shape is formed between the ring member 38 and the plate member 41.

An outer tube member 44 and an inner tube member 46, coaxial to the main shaft 24, are located inside the inner housing 12. The front end of the outer tube member 44 is welded to peripheral flange portion 381 of the ring member 38, and the front end of the inner tube member 46 is welded to peripheral flange portion 413 of the plate member 41. Therefore, a combustion chamber 48 of an annular shape located downstream of the pre-mixing chamber 40, is formed between the outer tube member 44 and the inner tube member 46. A plurality of pipe pieces 50 (FIG. 2) are welded to the outer tube member 44 at outer ends of the pipe pieces and are welded to the inner tube member 46 at inner ends of the pipe pieces. Therefore, the pre-heated air introduced into the passageway 52 as shown by an arrow D can be directed to the pipe pieces 50 as shown by an arrow E. The outer and inner tube members 44 and 46 have a plurality of air holes 441 and 461 therein, respectively. The air holes 441 and 461 are located on the downstream side of the combustion chamber 48. Therefore, the air introduced into the inner air passageway 52 as shown by the arrows D and E is mainly introduced, via the holes 441 and 461 as shown by arrows F, into a downstream portion $48_B$ (cooling zone) of the combustion chamber 48 to cool the temperature of a combustion gas formed in an upstream portion $48_A$ (combustion zone) of the combustion chamber 48.

The air which is not directed to the combustion chamber 48 is introduced into the annular shaped pre-mixing chamber 40 via a row of equiangularly spaced apart air intake holes 60, as shown by an arrow G, which holes are formed in the ring member 36 around the circumference thereof.

At least one fuel introducing pipe 66 is welded to the ring member 38 on one end of the pipe 66 in such a manner that the pipe 66 is communicated with a fuel hole 64 formed in the ring member 38 and opened to the fuel evaporation chamber 62. The fuel pipe 66 is, on the other end thereof, connected to a not shown liquid fuel tank. Thus, the liquid fuel from the tank can be supplied to the fuel chamber 62 via the pipe 66 and the hole 64. The liquid fuel supplied to the fuel chamber 62 is vaporized at a high temperature in the combustion zone $48_A$ which is located adjacent to the chamber 62. The ring member 38 has a row of equiangularly spaced vaporized fuel holes 70 of small dimension opened to both the evaporation chamber 60 and the pre-mixing chamber 40. The vaporized fuel in the chamber 62 is uniformly introduced into the pre-mixing chamber 40 via the fuel hole 70 as shown by an arrow H, and is mixed with the air which is introduced into the chamber 40 via the air intake hole 60 as shown by the arrow G, thereby causing a combustible air-fuel mixture to be formed.

The ring member 38 has, at a wall between the pre-mixing chamber 40 and the combustion chamber 48*a*, a row of equiangularly spaced inner injection nozzles 76, and a row of equiangularly spaced outer injection nozzles 76'. Thus, the combustible mixture in the pre-mixing chamber 40 is directed into the combustion chamber 48 via the inner injection holes 76 as shown by an arrow J and via the outer injection hole 76' as shown by an arrow J'. As will be clear from FIG. 1, the axes of a set of an inner hole 76 and an outer hole 76' are inclined to each other in such a manner that said axes intersect with each other at a position in the combustion chamber 48. Therefore a violent contact of the flows of combustible mixture as shown by the arrow J and J' occurs in the combustion chamber 48, causing a strong turbulence of the flow therein.

The gas turbine engine of the present invention further comprises a well known guide device 81 which is stationarily arranged inside the inner tubular housing 10 and which comprises a set of equiangularly spaced guide blades 82. The guide blades 82 face the downstream side of the annular combustion chamber 48 to receive high speed combustion gas from the chamber 48 as shown by the arrow K.

A set of equiangularly spaced turbine blades 80, which are fixedly secured to the main shaft 24 at a position apart from the compressor blades 28, are arranged inside the guide blades 82, so that the flow of combustion gas from the blades 82 is directed to the turbine blades 80 as shown by an arrow L, which causes the main shaft 24 to rotate.

In the operation of the above mentioned gas turbine engine, the intake air A from the not shown air cleaner is, as shown by the arrow B, directed toward the diffuser blade 30 at a very high speed, due to the rotation of the compressor blades 28. The air of high pressure from the diffuser blades 30 is directed, via the outer air passageway 32 of annular shape, as shown by the arrow B', to a not shown heat exchanging mechanism, as shown by the arrow C. The air pre-heated in the heat exchanging mechanism is introduced into the inner air passageway 52 of annular shape, as shown by the arrow D. Most of the thus introduced air is introduced into the downstream side of the annular combustion chamber 48 via the cooling air holes 441 and 461 as shown by the arrows F. The remaining air in the passageway 52 is introduced into the annular pre-mixing chamber 40 via the circumferentially arranged intake air holes 60, as shown by the arrow G. The thus introduced air is mixed with the vaporized fuel introduced into the pre-mixing chamber 40 from the annular fuel evaporation chamber 62 via the circumferentially arranged fuel holes 70, as shown by the arrow H. The thus formed combustible mixture is ejected into the annular combustion chamber 48 via the inner injection holes 76 and the outer injection holes 76', as shown by the arrows J and J', respectively. The ejected air-fuel mixture is burnt due to the high temperature in the combustion chamber to produce a combustion gas of high temperature. The combustion gas is cooled by the air introduced into the downstream side $48_B$ of the combustion chamber 48 via the holes 441 and 461, as shown by the arrows F, and is, via guide blades 82, as shown by the arrow K, directed to the turbine blades 80, as shown by the arrow L, to rotate the main shaft 24.

During the above-mentioned operation, since the axes of an inner injection nozzle 76 and a corresponding outer injection nozzle 76' are inclined with respect to each other in such a manner that said axes intersect at a position in the combustion chamber 48, a violent contact of the flows of the combustible mixture, as shown by the arrows J and J' occurs in a combustion zone $48_A$ of the combustion chamber 48, which causes a strong turbulence of flow in the combustion chamber 48. Thus, a rapid and stable combustion of the combustible mixture is effected in the combustion zone $48_A$. Due to the stable combustion, a relatively lean air-fuel mixture can be used without any difficulty, which permits a decrease of the temperature during the combustion process in the combustion zone $48_A$. Due to the rapid combustion, the length of flame caused by the combustion can be shortened. Thus, cool air can be introduced into the combustion chamber 48, as shown by the arrows F, at a position near the combustion zone $48_A$ which causes the combustion gas to be rapidly cooled. Since the amount of $NO_x$ emission corresponds to both the combustion temperature and the period required for combustion, as is well known to those skilled in this art, the amount of $NO_x$ emission is effectively suppressed according to the present invention.

Figure 2:
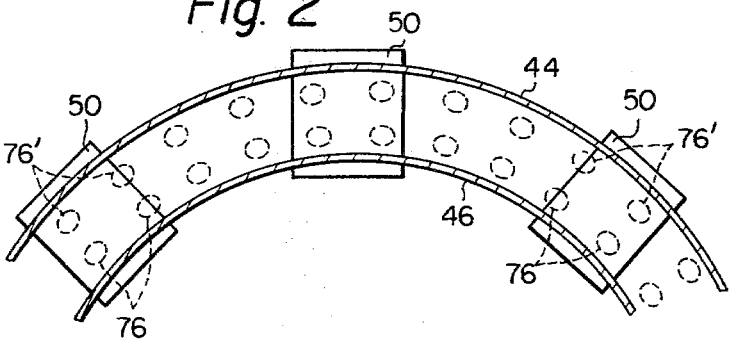
FIG. 2 is a sectional view taken along line II—II in FIG. 1.
Figure 3:
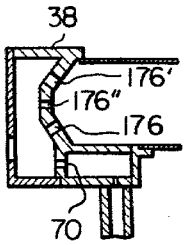
FIG. 3 shows a modified arrangement of injection nozzles in FIG. 1.

In a modification shown in FIG. 3, three rows of circumferentially arranged injection nozzles 176, 176' and 176'' are formed in the ring member 138. Other details of this modification are substantially same in the construction as shown in FIGS. 1 and 2.

Figure 4:
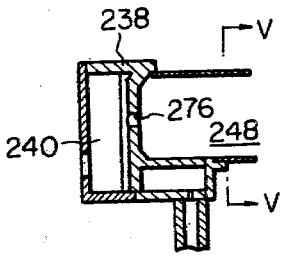
FIG. 4 shows another modified arrangement of injection nozzles in FIG. 1.
Figure 5:
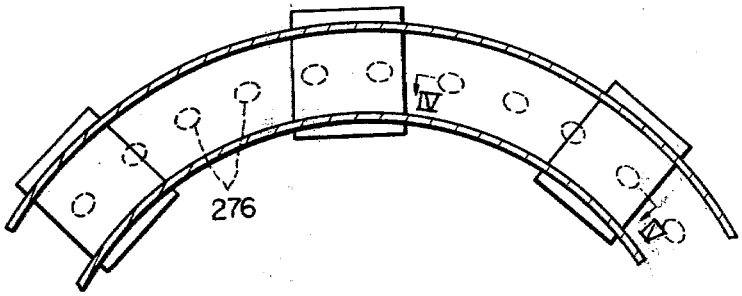
FIG. 5 is a sectional view taken along line V—V in FIG. 4.
Figure 6:
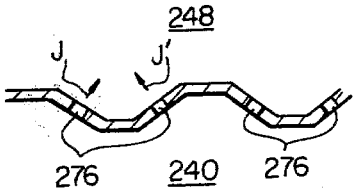
FIG. 6 is a sectional view taken along line IV—IV in FIG. 5.

In another modification shown in FIGS. 4, 5 and 6, a single row of equiangularly spaced injection nozzles 276 is formed in the ring member 238. As is clear from FIG. 6, the axes of two adjacent injection nozzles 276 are inclined with respect to each other in such a manner that a violent contact of the flows of the combustible mixture from the pre-mixing chamber 240 as shown by arrows J and J', respectively, occurs at the annular combustion chamber 248, with a strong turbulence to be generated therein. Therefore, a rapid and stable burning can be also effected in this embodiment.

While this invention has been illustrated by way of specific embodiments many modifications and changes can be made by those skilled in this art without departing from the scope and the spirit of the present invention.

What is claimed is:

1. A gas turbine comprising:

a housing assembly;

a shaft rotatably supported by the housing assembly;

a set of compressor blades fixed to the shaft, said housing assembly forming an outer air passageway of annular shape adapted for receiving a flow of air from the compressor blades and an inner air passageway of annular shape adapted for receiving the flow of air from the outer air passageway;

a set of turbine blades fixed to the shaft in the housing assembly so that the turbine blades are spaced apart from the compressor blades;

tube means for forming a combustion chamber inside the housing assembly, said combustion chamber, on a downstream side thereof, facing the turbine blades so that flow of combustion gas is directed toward the turbine blades to rotate the shaft;

a mixing chamber of annular shape in the inner air passage on an upstream side of the annular combustion chamber, said mixing chamber having a row of circumferentially arranged air intake holes through which air in the inner air passageway is introduced into the mixing chamber;

an annular wall between said mixing chamber and said combustion chamber; and means for introducing evaporative fuel into the mixing chamber for permitting the evaporative fuel to be mixed with the air in the mixing chamber to form a combustible mixture, the wall between said mixing chamber and said combustion chamber having a plurality of circumferentially spaced injection nozzle sets comprising an annular row of circumferentially spaced injection nozzles adapted for ejecting a combustible mixture in the mixing chamber into the combustion chamber, each of said nozzle sets being comprised of annularly successive pairs of next adjacent ones of said injection nozzles having axes which are inclined with respect to each other in such a manner that the axes intersect with each other at a position within the annular combustion chamber, whereby a violent contact of flows of a combustible mixture ejected from each set of the injection nozzles occurs in said combustion chamber, causing a strong turbulence of flow to be generated in the combustion chamber.

2. A gas turbine engine according to claim 1, wherein said mixing chamber is formed between said tube means and an annular ring means rigidly secured to the upstream side of said tube means and having said row of air intake holes therein.

3. A gas turbine engine according to claim 1, wherein said nozzles are substantially equiangularly spaced.

* * * * *